US006915931B2

(12) United States Patent
Gouldson et al.

(10) Patent No.: US 6,915,931 B2
(45) Date of Patent: Jul. 12, 2005

(54) GARMENT SET HANGER

(75) Inventors: Stanley F. Gouldson, Northport, NY (US); Olaf F. Olk, Hauppauge, NY (US)

(73) Assignee: Spotless Plastics Pty. Ltd., Victoria (AU)

( * ) Notice: Subject to any disclaimer, the term of this patent is extended or adjusted under 35 U.S.C. 154(b) by 36 days.

(21) Appl. No.: 10/431,094

(22) Filed: May 7, 2003

(65) Prior Publication Data

US 2004/0222252 A1 Nov. 11, 2004

(51) Int. Cl.[7] ..... A41D 27/22
(52) U.S. Cl. ..... 223/85; 223/88
(58) Field of Search ..... 223/85, 88; D6/315

(56) References Cited

U.S. PATENT DOCUMENTS 2,639,844 A * 5/1953 Udvardy ..... 223/68

* cited by examiner

*Primary Examiner*—Rodney M. Lindsey
*Assistant Examiner*—James G Smith
(74) *Attorney, Agent, or Firm*—Scully, Scott, Murphy & Presser

(57) ABSTRACT

A garment set hanger is disclosed which is suitable for hanging and displaying a set of matched or coordinated garments together, such as a matched set of children's garments. The garment set hanger includes a top hanger which is designed to support a top garment such as a dress or a shirt of the matched set of garments. A flexible bottom hanger of the garment set hanger is designed to support and display a matching bottom garment of the matched set of garments, such as underwear designed to be worn as a matched set with the dress, or matching pants designed to be worn as a matched set with a top sports or T shirt. The flexible bottom hanger is designed to be flexed inwardly to allow the bottom garment to be easily placed on and mounted onto the flexed bottom hanger, such as by an elastic waist band, and then the flexed bottom hanger is allowed to expand outwardly to conform to different size bottom garments.

20 Claims, 2 Drawing Sheets

GARMENT SET HANGER

BACKGROUND OF THE INVENTION

1. Field of the Invention

The present invention relates generally to a garment set hanger, and more particularly pertains to a garment set hanger which is suitable for hanging and displaying together a set of matched garments such as a matched set of children's garments. The garment set hanger is designed to display the set of matched garments together and to convey to a consumer the impression that the garments are designed to be purchased together as a matched set, and also to make it easier for the consumer to locate the matched set of garments.

2. Discussion of the Prior Art

It can be appreciated that many garments are designed to be worn and sold as coordinated outfits or sets. For example, a coordinate jacket and pants set, a coordinate jacket and top set, a coordinate short and top set, and other such coordinate combinations as are frequently specifically manufactured to be sold as matched sets. In the sale of such coordinate garment sets, it is desirable to display the garments together to convey to the consumer the impression that the garments are indeed a set to be purchased together. To that end the separate garments may be hung on separate hangers and displayed alongside or next to each other, or the garments may be hung on a single hanger. The drawbacks in such display methods are that in the first example of separate hangers, some frame or support is required to display the separately hung garments together, and in the second example of a single hanger, sharing a single hanger may obscure one of the individual garments that make up the coordinate garment set from display, or make it difficult to mount the coordinate garment set on the single hanger.

It can also be appreciated that a further benefit in displaying such coordinate garment sets together, or in displaying garments of a similar style and color together, is that the amount of required display space can be reduced significantly. A still further benefit of displaying such coordinate items together is to make it easier for the consumer to find and purchase such coordinate garment sets. This economy of space and ease of organization may also extend to the transportation and storage of such coordinate garment sets.

Moreover, in many cases, each separate garment of the coordinate garment set requires a hanger of a different type, such as a hanger suitable for displaying a blouse used with a hanger capable of supporting a skirt or a pair of slacks. For this purpose, it has long been a practice to utilize hanger structures in which two hangers are ganged together, with a lower hanger being suspended from a top hanger. In other cases, attachments have been designed with the attachment constructed to be temporarily or permanently connected to a supporting hanger.

These arrangements have often not been satisfactory because they have normally required the hangers to be of such a design that they do not have utility other than as ganged hangers for simultaneous multiple garment display and transport. Moreover, when hangers of conventional construction have been modified to permit ganging, they have involved either a difficult and complex structure for attaching one garment hanger to the other, or they have not been satisfactory in transportation because the vibration and jostling incident to transportation has frequently caused the hangers to become disconnected, allowing one of the garments to fall to the floor or the bottom of the transport container. This same lack of security of attachment has also been a problem at the point of display unless the hangers are carefully handled.

It is also an important requirement that the cost of manufacturing and selling of the hangers be maintained as low as possible to meet the necessities of the garment manufacturing and merchandising field.

SUMMARY OF THE INVENTION

The present invention provides a garment set hanger which is suitable for hanging and displaying a set of matched or coordinated garments together, such as a matched set of children's garments which does not obscure from display either of the individual garments that make up the coordinate garment set, and which is designed to make it easy to mount the coordinate garment set on the single hanger. The garment set hanger includes a top hanger which is designed to support a top garment such as a dress or a shirt of the matched set of garments. A flexible bottom hanger of the garment set hanger is designed to support and display a matching bottom garment of the matched set of garments, such as underwear designed to be worn as a matched set with the dress, or matching pants designed to be worn as a matched set with a top sports or T shirt. The flexible bottom hanger is designed to be flexed inwardly to allow the bottom garment to be easily placed on and mounted onto the flexed bottom hanger, such as by an elastic waist band, and then the flexed bottom hanger is allowed to expand outwardly to conform to different size bottom garments.

BRIEF DESCRIPTION OF THE DRAWINGS

The foregoing objects and advantages of the present invention for a garment set hanger may be more readily understood by one skilled in the art with reference being had to the following detailed description of several embodiments thereof, taken in conjunction with the accompanying drawings wherein like elements are designated by identical reference numerals throughout the several views, and in which.

DETAILED DESCRIPTION OF THE INVENTION

Figure 1:
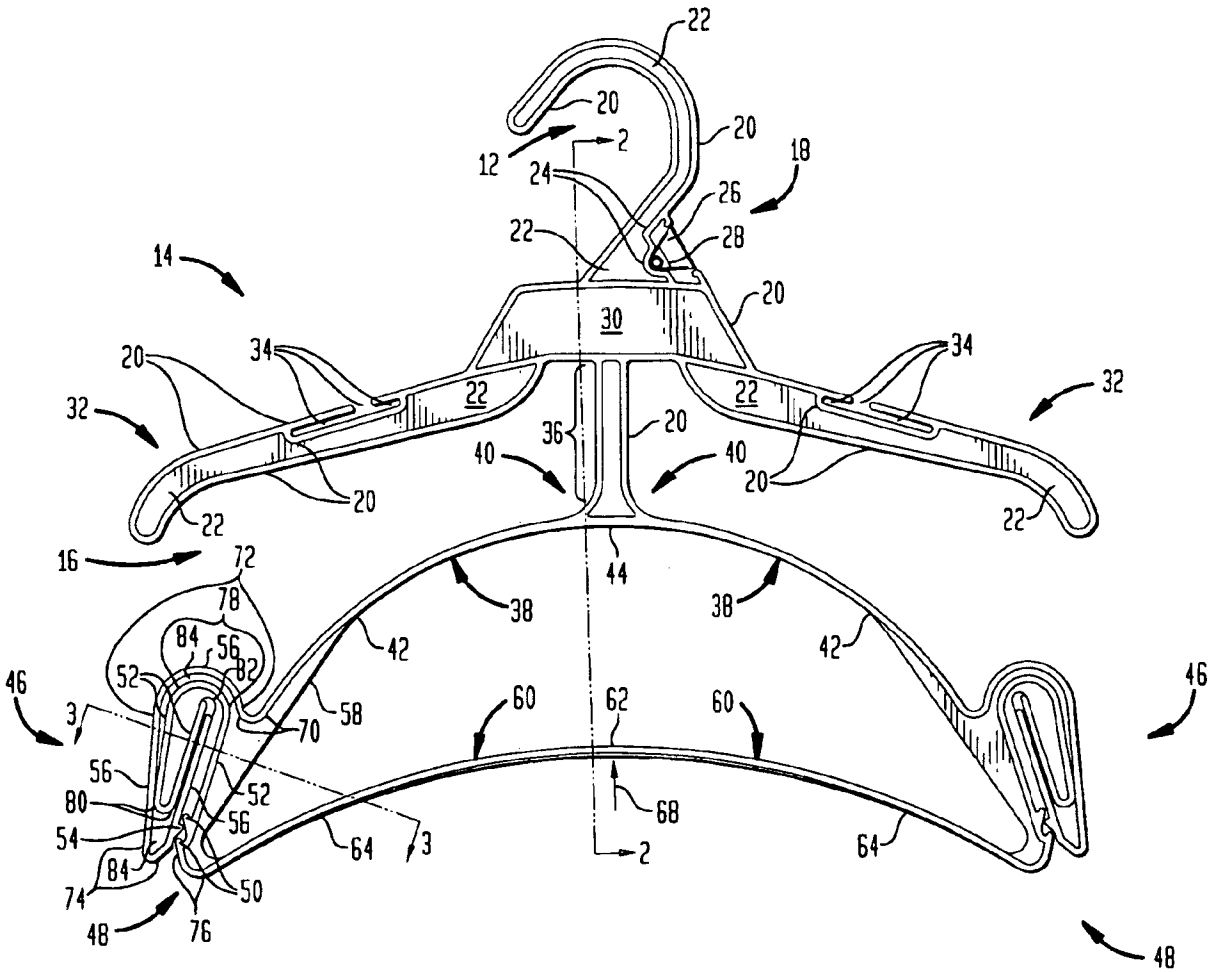
FIG. 1 is a front elevational view of one embodiment of a garment set hanger pursuant to the present invention which includes a top hanger hook, a top garment hanger depending from the top hanger hook, and a bottom garment hanger depending from the top garment hanger.

FIG. 1 is a front elevational view of one embodiment of a garment set hanger pursuant to the present invention which includes a top hanger hook 12, a top garment hanger 14 depending from the top hanger hook and a flexible bottom garment hanger 16 depending from the top garment hanger.

The garment set hanger includes a top centrally located hanger means, such as an inverted U shaped hanger hook 12 or an enlarged knob or a cross member structure designed to engage a slot, by which the garment hanger is suspended when the hanger means engages and hangs from a support such as a clothes rack. The top centrally located inverted U shaped hanger hook might or might not incorporate a releasable indicator tag to indicate to a consumer a size or other descriptive detail of a garment attached to a neck portion by an attachment means 18 or to a top portion of the top hanger hook, or to both the neck and top portions.

The hanger hook has a general I-beam construction wherein the hanger hook is provided with an enlarged thickness T peripheral flange 20 extending entirely around the outermost edge of the hanger hook, with opposite peripheral side flanges 20 being connected by a reduced thickness central web 22. The peripheral flange also extends around the inner peripheral edge 24 of the attachment means 18 for a releasable size indicator. The flange has an enlarged thickness which is substantially greater than the reduced thickness of the central vertical web of the hanger hook and reinforces the construction strength of the garment hanger hook.

Figure 2:
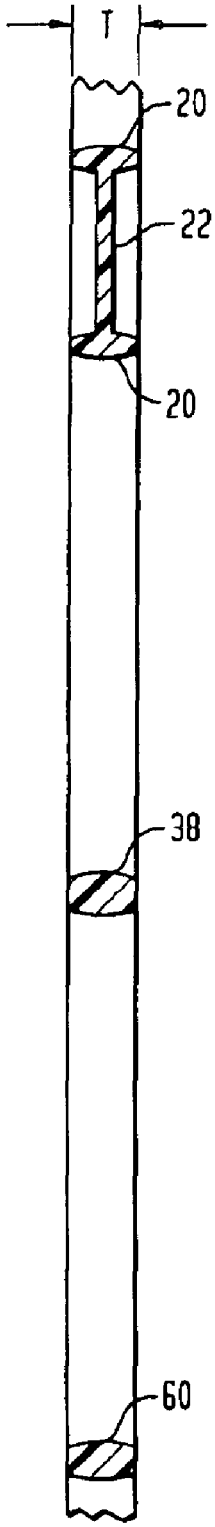
FIG. 2 is a sectional view through the top and bottom garment hangers of FIG. 1, taken along sectional arrows 2-2 in FIG. 1, and particularly illustrates details of the construction of the frame members of the top and bottom garment hangers of the garment set hanger.
Figure 3:
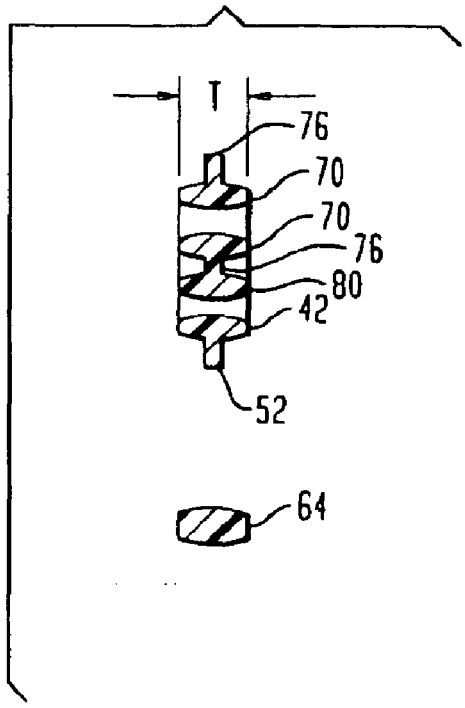
FIG. 3 is a sectional view through the left distal end of the bottom garment hanger of the garment set hanger, taken along sectional arrows 3-3 in FIG. 1, and particularly illustrates details of the construction of a garment clip located at each lateral distal end of the bottom garment hanger of the garment set hanger.

The embodiment shown in FIGS. 1–3 is designed to receive a releasable indicator at a neck portion between the top hanger hook 12 and the top garment hanger 14 of the garment set hanger. The releasable indicator is attached to a rounded triangular, reduced thickness, indicator receiving portion which terminates near the curved edge flange 24 formed where it joins the peripheral flange 20 around the hanger hook and also around the top hanger 14. A small triangular locking tab 26 is centrally located in the reduced thickness portion, and has a wedge shaped side profile, increasing in thickness in the direction of insertion of a releasable indicator thereon and terminating at edge 28, to secure a releasable indicator in place on the reduced thickness portion, the structure and details of which are described in greater detail in U.S. Pat. No. 6,264,075.

The top hanger 14 is formed integrally with and centrally below the inverted U shaped hanger hook, and is designed to support and display a top garment of the matched set of garments. The top hanger has a central body portion 30 and coplanar left and right downwardly sloping arms 32, which are symmetrically identical, extending from the central body member in left and right lateral directions. A garment/strap receiving opening and slot 34 is defined in the top of each of the left and right arms as is generally known in the art.

A vertically extending and elongated rectangular frame member 36 extends vertically downwardly from the central body portion of the top hanger to the flexible bottom hanger 16 which is centrally suspended below the top hanger and is designed to support a bottom garment of the matched set of garments.

The top hanger 14 and the vertical rectangular frame member 36 have a general I beam construction similar to the hanger hook 12 wherein the top hanger body and the rectangular frame member are provided with an enlarged thickness T peripheral flange 20 extending entirely around their outermost edges and also around the garment/strap receiving opening of the hanger body, with opposite peripheral side flanges being connected by a reduced thickness central web 22. The flange has an enlarged thickness T which is substantially greater than the reduced thickness of the central vertical web which reinforces the construction strengths of the top hanger and the vertical rectangular frame member.

The flexible bottom hanger 16 is designed to be able to be flexed inwardly to allow the bottom garment to be easily mounted on the inwardly flexed bottom hanger, after which the flexed bottom hanger is allowed to flex and expand outwardly to conform to the bottom garment while also accommodating different size bottom garments.

The flexible bottom hanger 16 comprises a top flexible frame member 38 which is centrally supported beneath the top hanger in an arrangement wherein the peripheral flanges 20 on opposite sides of the vertical frame member 36 curve smoothly into the top flexible frame member at 40. The top frame member includes a pair of downwardly sloping smoothly curved left and right top flexible frame members 42, which are symmetrically identical, extending in opposite lateral directions from a generally horizontal central portion 44.

Garment retainer clips 46 are mounted on top of the distal ends 48 of the left and right top flexible frame members of the flexible bottom hanger, and are symmetrically identical. Two outwardly and upwardly facing pincers 50 are formed on an enlarged width inner peripheral flange 52 extending along the outer upper edge of each of the lower ends of the left and right top flexible frame members, and bear against an inwardly and downwardly facing pincer 54 formed in an enlarged width outer peripheral flange 56 extending along an inner edge of a flexible arm of the garment retainer clip 46 to secure a garment therebetween.

A central flange 58 is mounted on the bottom of the distal half of each of the left and right frame members of the top flexible frame member to form with the inner peripheral flange 52 a T shaped structure, generally opposite to the garment retaining clip 46. The central flange 58 extends for approximately half the length of the top flexible frame member to the distal end 48 of each top frame member, such that the top flexible frame member flexes mainly along the proximal half of the frame member which is not reinforced by the central flange. The width of the central flange is widest at the location at which the garment retainer clip 46 is secured to the top of the top frame member and narrows as it proceeds upwardly and inwardly toward the central portion 44 and also narrows as it proceeds downwardly and outwardly toward the distal end 48. The central flange also extends between the integral joint formation of the distal ends of the top and bottom frame members at distal end 48 to reinforce that integral joint formation.

The top frame member 38 defines a rounded rectangular cross section as shown in FIG. 2 which has a vertical width which decreases gradually as it extends from the central top portion 44 downwardly and outwardly until it reaches the formation of the garment retainer clip 46, and then extends smoothly and integrally into the enlarged width outer peripheral flange 56 extending around the outer peripheral edge of the garment retainer clip 46.

The flexible bottom hanger 16 further includes a bottom flexible frame member 60 having a curved horizontal central portion 62 and a pair of downwardly sloping, smoothly curved left and right bottom flexible frame members 64 which are symmetrically identical. The left and right lateral distal ends of the left and right bottom flexible frame members are molded integrally with the left and right lateral distal ends of the top flexible frame member to form left and right rounded distal ends 48 which are symmetrically identical. The bottom flexible frame member defines a rounded rectangular cross section with a vertical width which is thickest at the central portion 62 of the bottom flexible frame member and which decreases gradually as it approaches the left and right lateral distal ends 48 at which it is thinnest. The arrangement is such that the central portion of the bottom flexible frame member is sufficiently strong to withstand the flexing while still providing adequate support for a garment being displayed on the bottom garment hanger.

The arrangement of the top and bottom frame members 38, 60 forms a downwardly facing crescent moon shaped structure. The arrangement is such that when the flexible bottom hanger is flexed inwardly to allow the bottom garment to be mounted thereon, both the top and bottom flexible frame members bow downwardly at their left and right lateral distal ends and become more curved, and the central portion of the bottom flexible frame member bows upwardly and moves nearer to the central portion of the top flexible frame member as indicated by arrow 68, such that the width of the downwardly facing crescent moon shape is decreased.

The lower hanger 16 is designed such that its left and right depending arms are flexible to allow the left and right depending hanger arms to be flexed inwardly towards each other while a garment is being mounted thereon, such as by a waist band of pants, after which the hanger arms flex outwardly to securely and neatly present the mounted garment on the garment hanger.

FIG. 2 is a sectional view through the top and bottom garment hangers of FIG. 1, taken along sectional arrows 2-2 in FIG. 1, and particularly illustrates details of the construction of the peripheral flange 20, the central web 22, and frame members 38, 60 of the top and bottom hangers of the garment set hanger. FIG. 2 shows that the enlarged thickness T of the peripheral flange 20 is equal to the thickness of the frame members 38, 60, to form a uniform thickness garment set hanger.

FIG. 3 is a sectional view through the left distal end of the bottom garment hanger of the garment set hanger, taken along sectional arrows 3-3 in FIG. 1, and particularly illustrates details of the construction of the garment retainer clip 46 located at each distal lateral end of the bottom garment hanger of the garment set hanger.

The structure and shape of the garment retainer clip provided on the upper distal end of each of the left and right arms of the lower hanger are symmetrically identical. The garment retainer clip 46 is integrally molded with the outer distal end of each top frame member 42 such that it extends approximately parallel to the top frame member at its distal end.

Referring in detail to the garment retainer clip 46, the enlarged width outer peripheral flange 56 formed around the outer peripheral edge of the garment retainer clip extends smoothly upwardly and outwardly from the top frame member 42 at a position spaced approximately one third of the length of the top frame member from its distal lateral end. The flange is the same thickness T as the top frame member and extends smoothly upwardly and outwardly from the top frame member in a first curve at 70 for slightly more than 90 degrees, and then curves back upon itself in a second curve 72 for slightly less than 180 degrees such that the flange then extends downwardly and outwardly approximately parallel to the top frame member while slowly approaching the top frame member along a first length. The flange 56 extends along the first length to a position approximately at the distal end 48 of the lower hanger, and then curves back on itself in a third snub nose curve 74 for slightly less than 180 degrees such that it then extends upwardly and inwardly approximately parallel to the inner peripheral flange 52 of the top frame member for a second length approximately equal to the first length to a distance just short of an inner terminal end 82 of the garment clip 46. The inwardly and downwardly extending pincer 54 is formed on the enlarged width outer peripheral flange 56 just above the third curve 74.

An enlarged width inner peripheral flange 52 is formed on the outer edge of the central flange 58 of the top flexible frame 42 generally opposite to the garment retainer clip 46 and also around the inner peripheral edge of the garment retainer clip. The flange is the same thickness T as the bottom frame member 64 and extends smoothly upwardly and inwardly from the distal end 48 of the bottom frame member in a first curve at 76. The outwardly and upwardly extending pincers 50 are formed on the enlarged width flange 52 just above the first curve 76, on opposite sides of the opposed inwardly and downwardly extended pincer 54. The flange 52 then extends upwardly and inwardly parallel to the opposed outer peripheral edge flange 56, and then curves back upon itself in a second curve 78 for slightly more than 180 degrees such that the flange then extends downwardly and outwardly approximately parallel to the outer peripheral edge flange 56 while slowly approaching the outer peripheral edge flange along a first length. The flange 52 extends along the first length, and then curves back on itself in a third curve 80 for slightly less than 180 degrees such that it then extends upwardly and inwardly parallel to the outer peripheral edge flange for a second length approximately equal to the first length to an inner terminal end 82 of the garment clip.

A central vertical web 84 extends integrally from the central flange 58 to connect the outer peripheral flange 56 to the inner peripheral flange 52 along the first and second lengths thereof to form an I shape cross section therewith, as shown in FIG. 3.

The arrangement is such that the bottom end of the resilient retainer clip arm can be bent away from the pincers 50 at the distal end of the upper frame while a garment is being inserted into the clip, and thereafter the resilient clip arm retracts toward the upper frame, to resiliently grip the garment between the pincer 54 on the resilient clip arm and the pincers 50 on the distal end of the upper frame. Thereafter, as the bottom hanger is allowed to expand to its unstressed shape, the garment is urged further within the grasp of the garment retainer clip. The pincers 50 and 54 have generally rounded triangular shapes pointed in a direction into the garment retainer clip to facilitate this urging of the garment further within the grasp of the garment retainer clip.

FIG. 3 illustrates that the enlarged width inner and outer peripheral edge flanges 52 and 56 and the bottom flexible frame member 64 all have the same thickness T to form a uniform thickness garment set hanger.

As illustrated in FIGS. 1–3, to maximize strength while using a minimum amount of plastic material, the central hanger hook, the top garment hanger, the elongated vertically extending frame member connecting the top and bottom garment hangers, and portions of the bottom garment hanger are constructed with an I shaped cross section having a first peripheral flange connected by a central vertically extending web to a second opposed peripheral flange. The flange extends completely around the upper central hook and around the inner peripheral portion of the releasable indicator, completely around the top garment hanger including the garment/strap receiving openings therein, and completely around the vertical frame member. The flexible bottom garment hanger and integrally molded retainer clip are designed with a variety of structural shapes including rounded rectangular shaped cross sections, T shaped cross sections and I shaped cross sections.

However, in alternative embodiments the different components of the set hanger may be constructed with a curved M-shaped cross-section, an E-shaped cross-section, a C-shaped cross-section, or any suitable cross-section which may improve the strength to weight ratio for particular applications to resist flexing due to the weight of the garments hanging from the set hanger of the present invention and to assist in maintaining the hanger upright when in use.

The garment hanger hook, top hanger, flexible bottom hanger and retainer clips are preferably formed as one integrally molded plastic piece from a suitable plastic material as is known in the art.

While several embodiments and variations of the present invention for a garment set hanger are described in detail herein, it should be apparent that the disclosure and teachings of the present invention will suggest many alternative designs to those skilled in the art.

Having thus described our invention, what we claim as new and desire to secure by Letters Patent is:

1. A garment set hanger for hanging and displaying a matched set of garments comprising:

a top hanger means from which the garment hanger is suspended when the hanger means engages and hangs from a support;

a top hanger suspended below the hanger means and designed to support and display a top garment of the matched set of garments and having left and right downwardly sloping arms extending in left and right opposite lateral directions;

a flexible bottom hanger suspended below the top hanger and designed to support a bottom garment of the matched set of garments, wherein the flexible bottom hanger is designed to be flexed inwardly to allow the bottom garment to be easily mounted on the inwardly flexed bottom hanger and then the flexed bottom hanger expands outwardly to conform to the bottom garment, the flexible bottom hanger comprising a top flexible frame member having a central portion and downwardly sloping left and right top flexible frame members extending in left and right opposite lateral directions from the central portion to left and right distal ends, and a bottom flexible frame member having a central portion and downwardly sloping left and right bottom flexible frame members extending in left and right opposite lateral directions from the central portion to left and right distal ends which are integrally molded with the respective left and right distal ends of the left and right top flexible frame members, such that when the flexible bottom hanger is flexed inwardly to hang the bottom garment, the top flexible frame member bows downwardly at its left and right distal ends and becomes more curved, and the bottom flexible frame member bows downwardly at its left and right distal ends and becomes more curved, and the central portion of the bottom flexible frame member bows upwardly and moves closer to the central portion of the top flexible frame member; and a garment retainer clip mounted on top of and near the distal end of each of the left and right top flexible frame members.

2. The garment set hanger of claim 1, wherein the top and bottom flexible frame members form a downwardly facing crescent moon shaped structure wherein when the flexible bottom hanger is flexed inwardly to allow a bottom garment to be mounted thereon, both the top and bottom flexible frame members bow downwardly at their left and right distal ends and become more curved, and the central portion of the bottom flexible frame member bows upwardly and moves nearer to the central portion of the top flexible frame member, such that the width of the downwardly facing crescent moon shape is decreased.

3. The garment set hanger of claim 2, wherein a vertical rectangular shaped frame member extends vertically downwardly from a central body member of the top hanger to the central portion of the top flexible frame member of the flexible bottom hanger which is centrally suspended below the top hanger.

4. The garment set hanger of claim 3, wherein peripheral flanges on opposite sides of the vertical rectangular shaped frame member curve smoothly into the central portion of the top flexible frame member.

5. The garment set hanger of claim 1, wherein the top flexible frame member defines a rounded rectangular cross section.

6. The garment set hanger of claim 5, wherein the rounded rectangular cross section has a vertical width which decreases gradually as it extends from the central top portion downwardly and outwardly.

7. The garment set hanger of claim 6, wherein the vertical width of the top flexible frame member decreases gradually until it reaches a garment retainer clip mounted on top of each left and right top flexible frame member.

8. The garment set hanger of claim 1, wherein the bottom flexible frame member defines a rounded rectangular cross section.

9. The garment set hanger of claim 8, wherein the rounded rectangular cross section has a vertical width which decreases gradually as it extends from the central top portion downwardly and outwardly to each distal end of the bottom flexible frame member.

10. The garment set hanger of claim 1, wherein the distal end of each of the left and right top flexible frame members forms at least one outwardly and upwardly facing pincer which bears against at least one inwardly and downwardly facing pincer on the garment retainer clip to secure a garment there between.

11. The garment set hanger of claim 10, wherein the pincers have generally rounded triangular shapes pointed in a direction into the garment retainer clip to facilitate urging of a garment further within the grasp of the garment retainer clip.

12. The garment set hanger of claim 1, further including a central flange mounted on bottom of each of the left and right top flexible frame members at a location opposite to the garment retainer clip secured to the top of the flexible frame member to form a T shaped structure generally opposite to the garment retainer clip.

13. The garment set hanger of claim 12, wherein the central flange extends for approximately half the length of the left and right top flexible frame members, such that the top flexible frame member flexes mainly along a length of the top flexible frame member which is not reinforced by the central flange.

14. The garment set hanger of claim 13, wherein the width of the central flange is widest opposite to the location at which the garment retainer clip is secured to the top of the top flexible frame member and narrows as it proceeds upwardly and inwardly toward the central support and also narrows as it proceeds downwardly and outwardly toward the distal end.

15. The garment set hanger of claim 12, wherein the central flange extends between and reinforces integrally molded distal ends of the top and bottom frame members of the bottom hanger.

16. The garment set hanger of claim 1, wherein the garment retainer clip is integrally molded with the distal end of each of the left and right top frame members to extend approximately parallel to the distal end of the top flexible top frame member.

17. The garment set hanger of claim 1, wherein the garment retainer clip includes an enlarged width outer peripheral flange formed around an outer peripheral edge of the garment retainer clip and extending smoothly upwardly and outwardly from the top frame member at a position spaced approximately one third of the length of the top frame member from its distal lateral end, the outer peripheral flange is the same thickness as the top frame member and extends smoothly upwardly and outwardly from the top frame member in a first curve for slightly more than 90 degrees, and then curves back upon itself in a second curve for slightly less than 180 degrees such that the flange then extends downwardly and outwardly approximately parallel to the top frame member while slowly approaching the top frame member along a first length to a position approximately at the distal end of the lower hanger, and then curves back on itself in a third curve for slightly less than 180 degrees and then extends upwardly and inwardly approximately parallel to an inner peripheral flange of the top frame member for a second length approximately equal to the first length toward an inner terminal end of the garment clip.

18. The garment set hanger of claim 17, wherein the garment retainer clip further includes an enlarged width inner peripheral flange formed on an outer edge of the top flexible frame generally opposite to the garment retainer clip and also around an inner peripheral edge of the garment retainer clip, the inner peripheral flange is the same thickness as the bottom frame member and extends smoothly upwardly and inwardly from a distal end of the bottom frame member in a first curve and then extends upwardly and inwardly parallel to the opposed outer peripheral edge flange, and then curves back upon itself in a second curve for slightly more than 180 degrees and then extends downwardly and outwardly approximately parallel to the outer peripheral edge flange while slowly approaching the outer peripheral edge flange along a first length, and then curves back on itself in a third curve for slightly less than 180 degrees and then extends upwardly and inwardly parallel to the outer peripheral edge flange for a second length approximately equal to the first length toward an inner terminal end of the garment clip.

19. The garment set hanger of claim 18, wherein the garment retainer clip further includes a second enlarged width flange which defines a rounded distal end of the garment retainer clip and extends from the distal end of the retainer clip upwardly and inwardly towards a pincer on top of the top flexible frame member for a first length, and then curves at a location just short of the pincer to extend parallel to the first flange to a position just beyond half the second length of the first flange, with the second flange resiliently bearing against the pincer with a resilience provided primarily by the first curve of the first flange as reinforced by the vertical web.

20. The garment set hanger of claim 1, wherein the top hanger means, top hanger and flexible bottom hanger are formed as one integrally molded plastic piece.

* * * * *